US007900892B2

(12) United States Patent
Student et al.

(10) Patent No.: US 7,900,892 B2
(45) **Date of Patent: *Mar. 8, 2011**

(54) LUBRICANT COMPOSITION AND CABLE PULLING METHOD

(75) Inventors: Joerg Student, Stuttgart (DE); Rickson Sun, Palo Alto, CA (US); Gregory W. Shaffer, Strongsville, OH (US); Donald Lelonis, Strongsville, OH (US); Paul Hans, Medina, OH (US); Robert Marchiando, Twinsburg, OH (US); Jennifer Klug, Strongsville, OH (US)

(73) Assignee: Momentive Performance Materials Inc., Albany, NY (US)

( * ) Notice: Subject to any disclaimer, the term of this patent is extended or adjusted under 35 U.S.C. 154(b) by 554 days.

This patent is subject to a terminal disclaimer.

(21) Appl. No.: 11/555,290

(22) Filed: Nov. 1, 2006

(65) Prior Publication Data

US 2008/0015122 A1 Jan. 17, 2008

Related U.S. Application Data

(60) Provisional application No. 60/807,550, filed on Jul. 17, 2006.

(51) Int. Cl.
*H02G 3/34* (2006.01)
*C10M 125/26* (2006.01)

(52) U.S. Cl. ..... 254/134.3 R; 254/4 R; 508/155

(58) Field of Classification Search ..... 508/155; 254/4 R, 134.3 R
See application file for complete search history.

(56) References Cited

U.S. PATENT DOCUMENTS

| | | | | |
|---|---|---|---|---|
| 3,925,216 | A | 12/1975 | Moorhouse | |
| 4,111,820 | A | 9/1978 | Conti | |
| 4,378,299 | A | 3/1983 | Alexander | |
| 5,002,675 | A | 3/1991 | Randisi | |
| 5,022,493 | A * | 6/1991 | Buckelew | 184/16 |
| 5,409,622 | A * | 4/1995 | Chapman et al. | 508/155 |
| 5,632,356 | A * | 5/1997 | Sells | 184/15.2 |
| 2004/0147409 | A1 * | 7/2004 | Tequi et al. | 508/156 |
| 2005/0202242 | A1 * | 9/2005 | Favereau et al. | 428/375 |

* cited by examiner

*Primary Examiner* — Glenn A Caldarola
*Assistant Examiner* — Vishal Vasisth
(74) *Attorney, Agent, or Firm* — Joseph E. Waters

(57) ABSTRACT

The present invention is directed to enhanced compositions that facilitate the pulling of cables through conduits. In one embodiment, the composition comprises a sufficient amount of boron nitride, which, upon application onto the cable surface, allows the cable to be pulled faster and/or with less force through the conduit than without the boron nitride present. The invention further relates to a method for pulling cables through conduits by applying an effective amount of boron nitride composition onto the cable surface. Lastly, the invention relates to an apparatus for distributing a cable-pulling composition comprising a block of boron nitride onto a cable as it is being pulled through a conduit.

16 Claims, 1 Drawing Sheet

LUBRICANT COMPOSITION AND CABLE PULLING METHOD

CROSS-REFERENCE TO RELATED APPLICATIONS

This application claims the benefits of U.S. No. 60/807550 filed Jul. 17, 2006, which patent application is fully incorporated herein by reference.

FIELD OF THE INVENTION

The invention relates to an apparatus for lubricating cable strands, and a method for pulling a cable strand or multiple cable strands.

BACKGROUND OF THE INVENTION

In the construction industry or in the building of new infrastructure or re-building of existing infrastructure, it is customary to lay cable and cable bundles which extend long distances in conduit pipe. Conduit pipe is essentially a pipe provided to serve as a channel or container in which the electrical cable is permanently housed. Typically, the conduit pipe is embedded in the ground or in a wall, and the cable or cable bundle is pulled through the conduit by hand or by mechanical means, such as with a winch. In general, the conduit pipe is provided with a diameter considerably larger than the diameter of the individual cables or cable bundle being housed by the conduit. However, large friction forces develop between the cable and the interior conduit walls, making it difficult to pull the cable through the conduit. If lubrication is used, it is customary to lubricate the cable or cable bundle at the entry end of the conduit to minimize the friction between the cable and the conduit walls. A lubricant is applied from the container directly to the cable or cable bundle as the cable is pulled through the conduit. A petroleum-based lubricant may be applied by hand onto the surface of the cable. U.S. Pat. No. 3,925,216 discloses a lubricant in the form of a liquid comprising an alcohol water solution of polyethylene oxide. U.S. Pat. No. 4,111,820 discloses a coating composition consisting essentially of an aqueous solution of a dispersion agent and polyethylene oxide. U.S. Pat. No. 4,378,299 discloses a lubricant in liquid or gel comprising an aqueous solution of from about 1 to 4% of a water soluble cellulose derivative containing about ½ to 2 wt. % of polyacrylamide. U.S. Pat. No. 5,002,675 discloses another cable lubricating composition including 10-30 wt. % propylene glycol, 0.1-1 wt. % sodium carboxymethyl cellulose, 0.01-1 wt. % hydroxyethyl cellulose, and 0.01-1 wt. % methyl paraben.

In practice, the petroleum-based lubricants of the prior art are often wiped or scraped from the cable soon after the particular section of cable has been drawn into the conduit. This makes further pulling difficult. The known aqueous-based pulling compositions can be stiff and nonthixotropic, can be hard to handle and apply to the surface, and can fail to reduce the coefficient of friction under a broad load range. The prior coatings can also be electrically conductive while they are wet, which makes them dangerous to use in a live circuit and/or extends the time before the power to the circuit can be turned on.

The invention relates to a novel composition for coating/lubricating cable strands, imparting them with excellent coefficient of friction properties; a novel apparatus for lubricating cable strands; and a method to lubricate and pull cable strands through a conduit. In one embodiment of the invention, the lubricating composition is in the form of a powder form, which adheres to the cable surface and facilitates pulling the cable strands through a conduit.

SUMMARY OF THE INVENTION

In one aspect of the present invention, the invention relates to an apparatus for lubricating a cable being drawn through a conduit. The apparatus comprises a means for pulverizing a block of lubricating composition, and a means for distributing the pulverized lubricating composition onto the cable as it is being drawn through the conduit.

In another aspect, the invention relates to a lubricating composition for pulling cables through conduits is disclosed. The composition comprises a cable-pulling effective amount of boron nitride, which allows the cable to be pulled through a conduit faster and/or using less pulling force than without the effective amount of boron nitride present. The cable-pulling composition containing boron nitride can be in the form of a gel; a grease; an oil; a solid stick, wand, or block; a spray, distributed as a pump or an aerosol; a paint; or a powder. The amount of boron nitride in the composition ranges from 0.1 to 99.9 wt. %, depending on the form used.

The invention further provides a method for facilitating the pulling of a cable through a conduit. The method includes delivering a composition containing 5 to 99.9 wt. % boron nitride to the cable at an entry of the conduit, and using the composition containing boron nitride as a lubricant while drawing the cable through the conduit.

DESCRIPTION OF THE INVENTION

Figure 1:
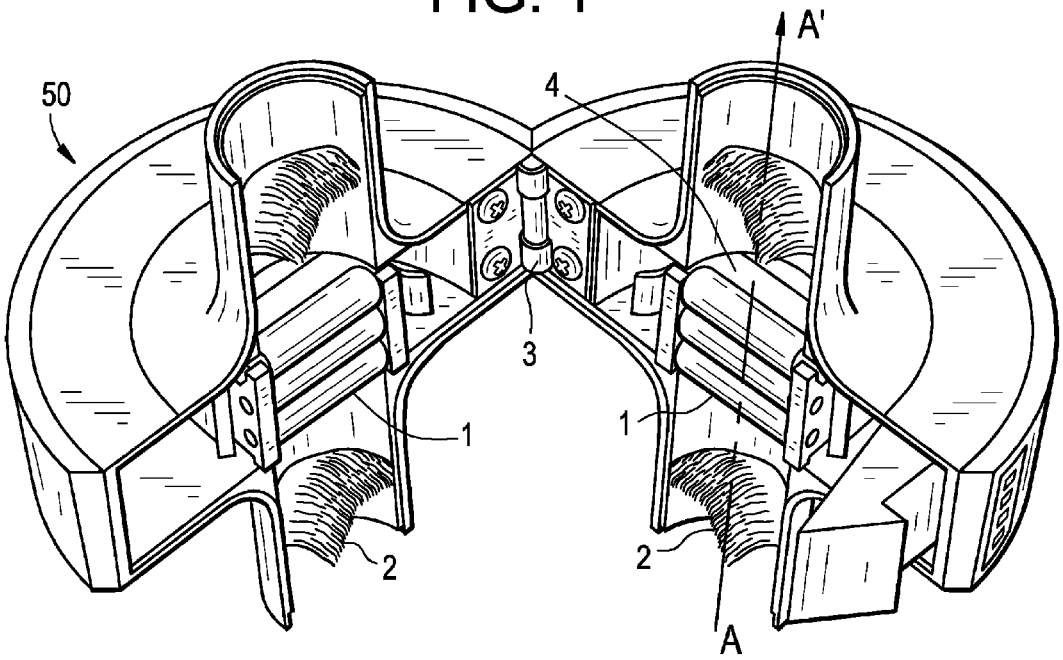
FIG. 1 is a perspective view of an apparatus for use with one embodiment of the cable-pulling composition of the invention, a boron nitride stick or block.

As used herein, approximating language may be applied to modify any quantitative representation that may vary, without resulting in a change in the basic function to which it is related. Accordingly, a value modified by a term or terms, such as "about" and "substantially," may not be limited to the precise value specified, in some cases.

As used herein, wires, cables, or similar lengthy conductors will be referred to as "cable," "wiring," "strand," or "strands" interchangeably; and the tube, duct, pipe section, or conduit, including the dies and fittings thereon, will be termed "conduit" or "conduit pipe."

As used herein, the term "cable-pulling composition" may be used interchangebly with "cable-lubricating composition," referring to a composition for use lubricating/coating a cable, allowing the cable to go through a conduit with reduced resistance, e.g., at least 20% less force, compared to an uncoated cable.

The term "an effective amount," as used herein, means an amount of the coating composition sufficient to pull a cable strand through a conduit with reduced resistance or pulling force than would be required without such a composition.

The cable-pulling compositions of the invention can be in the form of a gel; a grease; an oil; a solid stick, wand, or block; a spray, distributed as a pump or an aerosol; a paint; or a powder. In one embodiment, the composition is applied as a stick, a wand, or a block, in an apparatus that allows the block of the coating composition to be pulverized, thus distributing a coating onto the cable.

The cable-pulling compositions may comprise ingredients generally used in products of this type (a gel, a spray paint, etc.), well known to those skilled in the art, provided that they do not interfere with the boron nitride as the cable pulling key ingredient described herein.

Active Cable Pulling Ingredient—Boron nitride: Boron nitrides (BN), which can be used in the cable pulling composition of the invention, are commercially available from a number of sources, including, but not limited to, BN materials from GE Advanced Materials, Sintec Keramik, Kawasaki Chemicals, and St. Gobain Ceramics.

The BN for use in the composition of the invention can be in one of the following forms, or mixtures thereof, including amorphous boron nitride (referred to herein as a-BN); boron nitride of the hexagonal system, having a laminated structure of hexagonal-shaped meshed layers (referred to herein as h-BN); or a turbostratic boron nitride, having randomly oriented layers (referred to herein as t-BN). In one embodiment, the BN is in the turbostratic form, hexagonal form, or mixtures thereof.

In one embodiment, the BN particles have a primary average particle size of less than 100 μm. In a second embodiment, less than 50 μm. In a third embodiment, in the range of 10 to 30 μm. In a fourth embodiment, having an average particle size of less than 20 μm. In yet another embodiment, the boron nitride powder particles have a primary average particle size of less than 250 μm.

In one embodiment, the BN particles consist essentially of hBN platelets having an aspect ratio of from about 10 to about 300. In another embodiment, the BN particles have an oxygen content from 0.2 to 2.5 wt %. In another embodiment, the hBN particles have a graphitization index of less than 7.

In one embodiment, the composition is in the form of a block consisting essentially of boron nitride with the block of boron nitride having a density ranging from 0.20 to 1.500 g/cm3, and an $O_2$ concentration ranging from 0.2 to 1.3 wt. %, In one embodiment, the BN is surface-treated ("coated") to further impart lubricating characteristics to the ingredient. Examples of surface coating materials for the boron nitride powder include, but are not limited to, isohexadecane, liquid paraffin, non-ionic surfactants, dimethylpolysiloxane (or dimethicone), a mixture of completely methylated, linear siloxane polymers which have been terminally blocked with trimethylsiloxy units, a silazane compound possessing perfluoroalkyl groups, a zirconate coupling agent, a zirconium aluminate coupling agent, an aluminate coupling agent, and mixtures thereof Cable Pulling Compositions. The active BN cable-pulling composition is applied onto cable in various forms, including, but not limited to, a boron nitride-containing paint, grease, stick, wand, or block, cream, and powder.

In embodiments such as a paint, a grease, a cream, etc., the boron nitride cable-pulling material is mixed with a binder or carrier material, e.g., a water-soluble binder, aqueous emulsion, paraffin, a liquid silicone, oil, etc. There is no special limitation to the binder material usable in the cable pulling composition, so long as it does not interfere with the cable pulling ability of the BN agglomerate and has the retaining properties and binding abilities necessary for the agglomerate. Examples of the binder materials include, but are not limited to, polyvinyl alcohol, polyvinyl pyrrolidone, polyethylene glycol, etc. In one embodiment, other binder materials are also used in combination with alcohol binders, e.g., carboxymethyl cellulose, hydroxy propyl cellulose, methylethyl cellulose, and lignosulfonates. In yet another embodiment, additional inorganic binders, such as sodium silicate or other silicates, may also be used in very small amounts, e.g., less than 5 wt. %. The combination and percentages of the binders is not critical, but the amounts and combinations should not be so large as to interfere with the cable-pulling ability of the boron nitride, as noted above.

The total amount of boron nitride in the finished cable-pulling formulation may be varied within wide parameters, but should be such an amount for the composition to have a coating layer of boron nitride on at least 20% of the cable surface, to allow the cable to go through the conduit with reduced resistance, e.g., at least 20% less force, compared to the uncoated cable. This amount is a cable-pulling effective amount. Without this amount, cables are found to bind and are very difficult to pull through the conduit. In one embodiment, the cable-pulling effective amount is the amount sufficient to allow the cable to be pulled through the conduit with at least 10% reduced force, compared to the force required for an uncoated cable (i.e., 90% of the required force for an uncoated cable). In a second embodiment, a sufficient amount of cable-pulling formulation is applied for the cable to be pulled through the conduit with at least 50% reduced force, compared to the force required for an uncoated cable. In a third embodiment, a sufficient amount of cable-pulling formulation is applied for the cable to be pulled through the conduit with at least 90% reduced force.

In one embodiment, the composition is applied onto the cable leaving a coating of boron nitride powder of a thickness of 2 to 500 μm on the coated surface of the cable. In yet another embodiment, the coating layer containing boron nitride on coated cable has a thickness of 10 to 100 μm.

Generally, in one embodiment, the cable-pulling effective amount is in the range of 0.1 to 99.9 wt. %, based on the total weight of the cable-pulling formulation. In one embodiment, the amount is 2 to 95 wt. %. In a second embodiment, the amount ranges from 2 to 75 wt. %. In a third embodiment, from 5 to 50 wt. %. In a fourth embodiment, this amount is less than 15 wt. %. In a fifth embodiment, this amount ranges from 5 to 30 wt. %.

In addition to the boron nitride component as the principal cable-pulling ingredient, at least one binder/carrier component may be included, depending on the form of the application. The composition can also contain a variety of additives known in the art, including, but not limited to, agitants, dyes, colorants, preserving agents, surfactants, or corrosion inhibitors.

1st Embodiment—Cable Pulling Liquid

In one embodiment, the cable pulling composition is in the form of a boron nitride liquid, e.g., a BN paint with high lubricity as well as good adherence to the cable surface, resulting in a dried composition of BN. In one embodiment, the boron nitride cable-pulling composition is in the form of a BN paint containing 50 to 100 parts by weight of BN; 25 to 75 parts by weight of an acrylic, such as vinyl acrylic; and 100 to 200 parts by weight of a volatile liquid, such as an alcohol.

The BN cable-pulling composition can be applied in a liquid form directly to the cable surface using a conventional liquid application technique, such as washing, brushing, painting, spraying, or the like. In one embodiment, the cable pulling comprising BN is applied using an apparatus as disclosed in U.S. Pat. No. 4,569,420, wherein a nozzle, on a nozzle head secured to the leading end of the cable, is provided, so that while the cable is pulled through the conduit, the BN cable-pulling composition is sprayed onto the interior walls of the conduit, ahead of the leading end of the cable being pulled. In yet another embodiment, the composition is applied onto the cable using an apparatus as disclosed in U.S. Pat. No. 4,296,837, with a split ring carrying a plurality of nozzles for dispensing the BN cable-pulling composition onto the cable being pulled through the conduit.

Cable pulling compositions in a form similar to BN paints are commercially available and can be obtained from a number of sources, including GE Advanced Materials of Strongsville, Ohio.

2nd Embodiment—Cable Pulling BN Block

In one embodiment, the cable-pulling composition is in the form of a wand, a stick, or a block. In one embodiment, the solid block contains 5 to 40 wt. % boron nitride, optional lubricants, such as molybdenum disulfide of 0 to 50 wt. %, PTFE of 0 to 50 wt. %, calcium carbonate of 5 to 50 wt. %, and/or optional minerals, such as mica, sericite, and talc in 0 to 30 wt %. In another embodiment, wherein the block consists essentially of boron nitride or boron nitride in combination with electrically-insulating lubricants such as PTFE, the cable-pulling composition is electrically insulating upon application to the cable, allowing the power to the circuit to be turned on after application, without the additional waiting time normally required to allow an electrically-conductive composition to dry.

In yet another embodiment, the cable-pulling composition employs BN as the primary solid component, with a block comprising 0 to 99.9 wt. % of h-BN and 0 to 99 wt. % of t-BN. In one embodiment, the block is formed using the following process: a mixture of high oxygen t-BN and optional carbon additive is first cold pressed via a known method, such as uniaxial pressing, filter pressing, or isostatic pressing, and is then heated to a temperature of 1500-2300° C. for 1 to 40 hrs., forming a block of sintered BN, having a density ranging from 0.20 to 1.50 g/cm$^3$.

In yet another embodiment, the cable-pulling block employs synthetic wax, paraffin, or an organophosphate, such as triphenyl phosphate, as a carrier. The BN cable-pulling component is added to the melted liquid carrier. Then, the mixture thus formed is poured into molds, where the mixture is allowed to cool and the carrier is allowed to solidify. The molds can produce a bar or other desired shape.

In one embodiment, the cable-pulling block employs synthetic or natural wax, paraffin, or an organophosphate, such as triphenyl phosaphate, as a carrier. The BN component is dry blended with the carrier component using a v-blender. The dry mixture is then charged into a mold, heated to 250° F., and pressed at a pressure of between 250 and 1500 psig, cooled to room temperature, and de-moulded to form a bar or other desired shape.

3rd Embodiment—Cable Pulling Grease or Oil

In one embodiment, the cable-pulling composition is in the form of a grease or oil, which can be applied onto the cable surface via junction boxes at various intervals for additional lubrication of the cable.

In one embodiment, the cable-pulling composition is a grease, containing 1- to 30 wt. % of the boron nitride active ingredient in a carrier of a mineral or synthetic oil. The grease composition in one embodiment further comprises at least one of a mineral thickener such as acetylene black, talc, clay, or silica in an amount of 2 to 30 wt. %. In another embodiment, the grease composition further comprises ingredients such as lithium soap, polyurea, sodium soap, calcium soap, aluminum soap, aluminum-complex soap, calcium complex soap, calcium sulfonates, lithium complex soap, bentonite, graphite/carbon, PTFE, indianthrene dye, polyethylene, or phthalocyanine dye in an amount of 1 to 30 wt %.

In one embodiment, a cable-pulling grease, containing boron nitride, is applied onto the cable surface using an apparatus as disclosed in U.S. Patent Publication No. 2004/0035642, wherein a plastic device is used to dispense the composition onto a strand of cable, while the cable is being pulled through a conduit. This plastic device has embedded channels that carry the cable-pulling composition under pressure from an inlet to outlets, at which points the lubricant is dispensed. In another embodiment, the BN-containing cable pulling grease is injected into the conduit through fittings, as disclosed in U.S. Pat. No. 3,565,213.

In one embodiment, wherein the cable pulling composition is in an oil form, an apparatus as disclosed in JP Patent Publication No. 07-0878640 is used in conjunction with compressed air to blow the composition onto the cable, thus distributing the composition and facilitating the cable pulling process.

The invention is further illustrated by the following non-limiting examples:

EXAMPLE 1

BN Cable-Pulling Block

A mixture comprising 29.4 wt. % h-BN powder with an oxygen content of 0.3 wt % (grade AC6004 from GE Advanced Materials), 68.6 wt. % of t-BN with an oxygen content of 15 wt % (also from GE Advanced Materials), and 2 wt. % of carbon black (grade N991 from Cancarb) is homogenously blended together. The blend is pressed in a uniaxial press, forming a plurality of blocks. The blocks are then sintered for 10-30 hours at 1800-2300° C., forming low-density BN blocks with density ranging from 0.20 to 1.50 g/cm$^3$, and with a fired $O_2$ concentration of <1.0 wt

EXAMPLE 2

Apparatus for Dispensing the Cable-Pulling Composition:

In this example, the BN block fabricated in Example 1 is employed in the apparatus 50, as illustrated in FIG. 1, for an easy supply of the cable-pulling composition during drawing of cable.

In the figure, a boron nitride stick or block (not shown) is confined in the space behind rollers 1. As a cable is pulled through the apparatus in the direction of A-A', the BN block is pulverized via the roller assembly, thus forming a coating on most, if not all, of the cable surface being pulled through. The apparatus 50 is provided with a plurality of flat blades 4, which function to contain the pulverized BN material confined within the roller assembly. A plurality of brushes 2, provided at the entry and exit of the apparatus, help with the distribution of the cable pulling composition onto the cable surface. In one embodiment, only one single (circular brush is provided) at either the entry or exit of the apparatus for the distribution of the composition onto the cable surface.

Assembly pin 3 holds the apparatus housing parts in place during assembly/disassembly to replace the boron nitride stick.

Figure 2A:
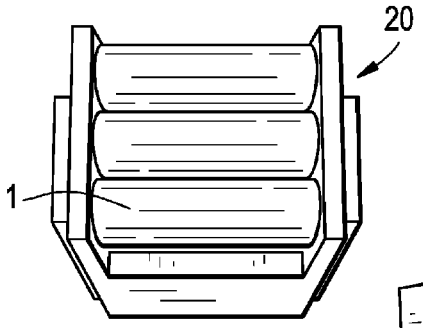
FIG. 2A is a top view of the roller assembly employed in the apparatus of FIG. 1.
Figure 2B:
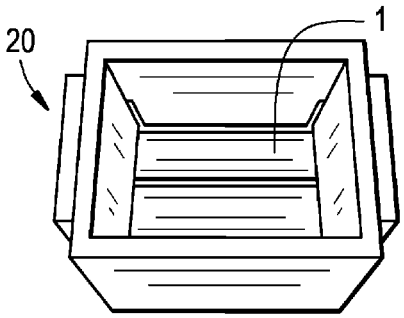
FIG. 2B is a back view of the roller assembly of FIG. 2A.

FIG. 2A is a top view of the roller assembly 20, which functions to facilitate the drawing of the cable through the assembly, while simultaneously coating the cable with the pulverized BN cable-pulling composition. In the figure, assembly 20 comprises a plurality of rollers 1 (on each side of the apparatus). However, the number of rollers used shall depend on a number of factors, including, but not limited to, the density of the BN composition used, the size of the cable to be pulled through, etc. In one embodiment, the rollers' surface is roughened/uneven with a plurality of ridges or raised pinholes (not shown), facilitating the pulverization of the cable-pulling block containing boron nitride. In yet another embodiment (not shown), the plurality of parallel and rotatably mounted rollers having a plurality of axially extending spikes or raised notches thereon for gripping the cable-pulling composition block and pulverizing the material. FIG. 2B is a back view of the roller assembly of FIG. 2A, showing a hollow space for housing a block of the cable-pulling composition containing BN.

Figure 3:
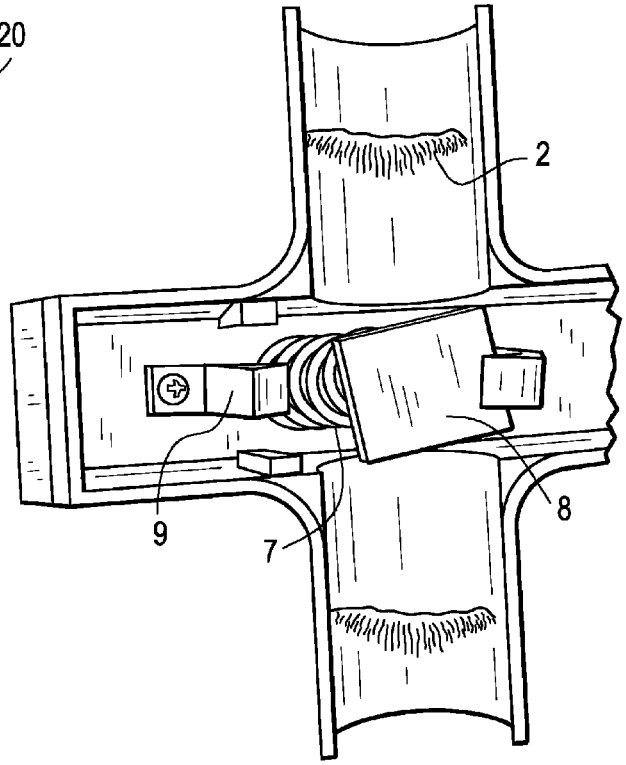
FIG. 3 is a perspective view of the structure pressing the boron nitride stick or block against the roller assembly of FIGS. 2A and 2B, wherein the boron nitride is pulverized against the roller assembly, thus lubricating a cable being pulled through the apparatus.

As best seen in FIG. 3, a BN block (not shown in the figure), placed on top of platform 8, is pressed against rollers 1 by spring 7. In one embodiment as shown, platform 8, attached to spring 7, is employed to compress/bias the BN block against the plurality of rollers 1. Clips 9 are for fastening the roller assembly in place. In a cable pulling operation, the cable-pulling BN block is pulverized against the roller for lubricating a cable being pulled through the rollers, and brushes 2 function as a means to distribute the BN powder onto the cable surface.

EXAMPLE 3

Apparatus for Dispensing the Cable-Pulling Composition:

In this example, the rollers of Example 2 are removed, allowing the cable-pulling block to be pressed directly against the cable being pulled through the conduit. The cable, in this example, has a roughened surface texture jacket, thus directly abrading the BN block, and causing BN powder to be deposited directly onto the cable/wire jacket.

It should be noted that the cable-pulling composition for use with the cable lubricating/lubricant dispensing apparatus illustrated in the Figures does not need to be in the form of a block, a stick or a wand. In one embodiment, boron nitride powder is dispensed into the hollow space of FIG. 2B, which powder subsequently flows through the roller assembly for uniform mixing prior to be distributed onto the cable. In another embodiment (not shown), the roller assembly is replaced with a screen mesh allowing a cable pulling composition in the form of a powder to sieve through onto a cable as it is being pulled through the conduit. In yet another embodiment (not shown), the roller assembly is replaced with a plurality of plates with raised ridges for a roughened surface texture on the plates. The roughened surface texture assembly can be used with a cable pulling composition in the form of a powder, or a block. As the block is pressed against the roughened surface, it is pulverized by the rough surface and subsequently distributed on the cable as it is pulled through the conduit.

Although not illustrated in any of the drawings, in one embodiment, a cable pulling mechanism is provided for use in conjunction with the lubricating apparatus. The mechanism engages the lubricating apparatus by intermittently applying pressure on the apparatus and/or gripping the cable and pulling the cable through the lubricating apparatus. In yet another embodiment, a cable supplying mechanism is provided. The cable supplying means comprises a supply of cable, and a motor operable to cause spooling-out the cable the supply at a predetermined rate of speed in response to the movement of the cable through the conduit. In one embodiment, the cable pulling mechanism comprises a plurality of members for alternately gripping, pulling and releasing the cable, effectively allowing the cable to be pulled through the apparatus/conduit as it is being lubricated.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims, if they have structural elements that do not differ from the literal language of the claims, or if they include equivalent structural elements with insubstantial differences from the literal languages of the claims.

All citations referred herein are expressly incorporated herein by reference.

The invention claim is:

1. A method for lubricating cable being pulled through a conduit, the method comprises the steps of:

applying a cable-pulling composition containing 2 to 99.9 wt. % boron nitride onto the cable at an entry of the conduit;

using the composition containing boron nitride as a lubricant while drawing the cable through the conduit;

wherein the composition leaves a cable-pulling effective amount of boron nitride on the cable, allowing the cable to be pulled through the conduit using a reduced force, compared to the force required to pull an uncoated cable without the cable-pulling effective amount of boron nitride through the conduit, wherein the composition is a powder or a solid.

2. The method of claim 1, wherein the composition leaves a cable-pulling effective amount of boron nitride on the cable for the cable to be pulled through the conduit with less than 80% the amount of the force required to pull through an uncoated cable without the cable-pulling effective amount of boron nitride present.

3. The method of claim 1, wherein the composition leaves a cable-pulling effective amount of boron nitride on the cable for the cable to be pulled through the conduit with less than 50% the amount of the force required to pull through an uncoated cable without the cable-pulling effective amount of boron nitride present.

4. The method of claim 1, wherein the composition leaves a cable-pulling effective amount of boron nitride on the cable for the cable to be pulled through the conduit with less than 10% the amount of the force required to pull through an uncoated cable without the cable-pulling effective amount of boron nitride present.

5. The method of claim 1, wherein composition comprises 2 to 75 wt. % boron nitride.

6. The method of claim 1, wherein composition comprises 5 to 50 wt. % boron nitride.

7. The method of claim 1, wherein the composition comprises boron nitride having a primary average particle size ranging from 0.5 to 125 μm.

8. The method of claim 1, wherein the composition comprises 5 to 50 wt. % boron nitride, and wherein the boron nitride has a primary average particle size ranging from 2 to 60 μm.

9. The method of claim 1, wherein the composition comprises 2 to 50 wt. % of boron nitride dispersed in a carrier selected from one of a petroleum-based oil, a synthetic oil, a water-oil emulsion, and an aqueous liquid.

10. The method of claim 1, wherein the composition is a solid stick consisting essentially of boron nitride having a density ranging from 0.20 to 1.500 g/cm$^3$, and an $O_2$ concentration ranging from 0.2 to 1.3 wt. % .

11. The method of claim 1, wherein the composition is a solid stick, comprising 2 to 99.5 wt. % of hexagonal boron nitride, turbostratic boron nitride, or mixtures thereof.

12. The method of claim 1, wherein the composition is a solid stick, comprising 95 to 99.5 wt. % of hexagonal boron nitride, turbostratic boron nitride, or mixtures thereof.

13. The method of claim 1, wherein the composition is a solid stick, comprising 10 to 99.5 wt. % of hexagonal boron nitride, turbostratic boron nitride, or mixtures thereof, and 0.5 to 90.0 wt. % of at least one of a binder, a lubricant, a filler and mixtures thereof.

14. The method of claim 1, wherein the composition leaves a coating layer having a thickness of 2 to 500 μm on the coated contact surface.

15. The method of claim 1, wherein the composition leaves a coating layer having a thickness of 10 to 100 μm on the coated contact surface.

16. The method of claim 1, wherein the composition is applied onto the cable surface by brushing using a plurality of rollers for the cable surface to be at least 20% coated with the composition.

* * * * *